US007331823B2

(12) United States Patent
Fukushima et al.

(10) Patent No.: US 7,331,823 B2
(45) Date of Patent: Feb. 19, 2008

(54) SHIELDED-CONDUCTOR CABLE FIXING CONSTRUCTION

(75) Inventors: Hirotaka Fukushima, Haibara-gun (JP); Takashi Tsukamoto, Haibara-gun (JP); Masanori Tsuji, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/137,790

(22) Filed: May 26, 2005

(65) Prior Publication Data

US 2005/0266729 A1 Dec. 1, 2005

(30) Foreign Application Priority Data

May 26, 2004 (JP) ..... P2004-155722

(51) Int. Cl.
*H01R 9/03* (2006.01)

(52) U.S. Cl. ..... 439/610; 439/904

(58) Field of Classification Search ..... 439/610, 439/904, 905
See application file for complete search history.

(56) References Cited

U.S. PATENT DOCUMENTS

| | | | | |
|---|---|---|---|---|
| 4,508,414 | A * | 4/1985 | Kusui et al. | 439/610 |
| 4,822,304 | A * | 4/1989 | Herron | 439/610 |
| 5,401,177 | A * | 3/1995 | Dutton et al. | 439/98 |
| 6,648,683 | B2 * | 11/2003 | Youtsey | 439/578 |
| 2005/0266729 | A1 * | 12/2005 | Fukushima et al. | 439/610 |

FOREIGN PATENT DOCUMENTS

JP 2002-329557 A 11/2002

* cited by examiner

*Primary Examiner*—James R. Harvey
(74) *Attorney, Agent, or Firm*—Sughrue Mion, PLLC.

(57) ABSTRACT

A braided conductor of a shielded-conductor cable is fitted on a ring of a shield shell in such a manner as to expand an inside diameter thereof in such a state that a portion of an open end portion of the braided conductor is folded over on itself on an inside diameter side of the open end portion so as to be doubled inwards and an annular member is held in the doubled portion of the open end portion.

4 Claims, 6 Drawing Sheets

SHIELDED-CONDUCTOR CABLE FIXING CONSTRUCTION

BACKGROUND OF THE INVENTION

The present invention relates to a shielded-conductor cable fixing construction in which an insulated electric wire is covered with a tubular braided conductor and an open end portion of the braided conductor is fitted on a shield shell in such a manner as to expand an inside diameter of the braided conductor at the open end portion so that the braided conductor is connected to the shield shell.

Some fixing constructions for shielded-conductor cables have been known (for example, refer to Patent Document 1). FIGS. 5 and 6 are both perspective views showing an equipment shield connector disclosed in Patent Document 1.

As shown in FIGS. 5 and 6, in an equipment shield connector 30, a shielding member 31 encloses a plurality of electric wires (not shown) altogether therein and is fixed to a shield shell 32 at a terminal portion thereof so as to be connected to a shield case (not shown) via the shield shell 32. The terminal portion of the shielding member 31 is held between an inner tubular portion 33*a* of an inner shell 33 of the shield shell 32 and an outer tubular portion 34*a* of an outer shell 34 thereof and between a flange 33*b* of the inner shell 33 and a flange portion 34*b* of the outer shell 34 to thereby be fixed to the shield shell 32.

In addition, as shown in FIGS. 7 and 8, there is a shielded-conductor cable fixing construction, as an fixing construction for a shielded-contactor cable 40, in which a tubular braided conductor 41 which covers a plurality of insulated electric wires (not shown) of the shielded-conductor cable 40 is fitted on a ring 42*a* of a shield shell 42 in such a manner as to expand an inside diameter of an open end portion 41*a* of the tubular braided conductor 41 so that the braided conductor is connected to the shield shell 42. The shield shell 42 is coupled and connected to a shield case (not shown), so that the braided conductor 41 is grounded to the shield case. Patent Document 1:JP-A-2002-329557 (page 5, FIGS. 5 and 8)

In the related equipment shield connector 30 shown in FIGS. 5 and 6, in the event that interstices of the shielding member 31 are rough, there are made many gaps in the terminal portion of the shielding member 31, whereby a high shielding performance cannot be obtained. In addition, since the friction between the terminal portion of the shielding member 31 and the shield shell 32 becomes small, the fixing force of the shielding member 31 to the shield shell 32 becomes weak, leading to a problem that the shielding member 31 easily comes off the shield shell 32.

In addition, also in the related fixing construction for a shielded-conductor cable 40 shown in FIGS. 7 and 8, interstices of the braided conductor 41 at the open end portion 41*a* become rough as the inside diameter of the braided conductor 41 expands in association with the fitting on the ring 42*a* of the shield shell 42. Due to this, as with the related equipment shield connector 30 shown in FIGS. 5 and 6, not only the high shielding performance cannot be obtained but also the fixing force of the braided conductor 41 to the shield shell 42 becomes weak, leading to a problem that the braided conductor 41 easily comes off the shield shell 42.

Furthermore, in the case of either the related equipment shield connector 30 shown in FIGS. 5 and 6 or the related fixing construction of a shielded-conductor cable 40 shown in FIGS. 7 and 8, in the event that the interstices of the terminal portion of the shielding member 31 or the open end portion 41*a* of the braided conductor 41 are formed so as to be dense even in such a state that the inside diameter is expanded as shown in FIG. 7, the aforesaid problems can be solved.

In order to have dense interstices at the terminal portion of the shielding member or the open end portion of the braided conductor, however, there has been a problem that tremendous amounts of costs and time are needed to produce shielding members or braided conductors.

In addition, a sharply pointed distal end portion of the shielding member 31 or the braided conductor 41 protrudes outwards at the terminal portion of the shielding member 31 or the open end portion of the braided conductor 41 in such a state that the terminal portion of the shielding member 31 or the open end portion 41*a* of the braided conductor 41 is fitted on the shield shell 32 or the shield shell 42. Due to this, a post-treatment such as of cutting the sharply pointed distal end portion of the shielding member 31 or the braided conductor 41 becomes necessary, leading to a problem that the production costs are increased.

SUMMARY OF THE INVENTION

The invention was made in view of the situations and an object thereof is to provide a shielded-conductor cable fixing construction which can enable the securing of high shielding properties and the strong and rigid fixing of the braided conductor to the shield shell at low costs without a need for making dense the interstices of the braided conductor.

In order to accomplish the above object, a shielded-conductor cable fixing construction of the present invention is characterized by having the following arrangement:

(1) A shielded-conductor cable fixing construction comprising:

a shield shell; and a tubular braided conductor that covers an insulated electric wire, and has an open end portion that is fitted on the shield shell in such a manner as to expand an inside diameter of the open end portion, and that the expanded open end portion is folded over so as to be doubled inwards, so that the braided conductor is connected to the shield shell.

(2) A shielded-conductor cable fixing construction according to (1) further comprising an annular member that is interposed in the doubled open end portion to ensure the folding over on the open end portion at a predetermined position.

(3) A shielded-conductor cable fixing construction according to (1), wherein the shield shell has a ring portion, and the doubled open end portion is clamped by a pair of dices, each of which has a shape according to a shape of the ring portion, between the ring portion and the dices.

(4) A shielded-conductor cable fixing construction according to (3), wherein the doubled open end portion is fastened by a band on an outside diameter portion of the doubled open end portion.

According to the invention, the securing of high shielding properties and the strong and rigid fixing of the braided conductor to the shield shell can be enabled at low costs without a need for making dense the interstices of the braided conductor.

In addition, the securing of high shielding properties and the strong and rigid fixing of the braided conductor to the shield shell can be enabled at low costs without a need for making dense the interstices of the braided conductor. In addition, the braided conductor can be folded over on itself on the inside diameter side of the open end portion in an ensured fashion at a predetermined position of the open end portion, thereby making it possible to enable the fixing of the braided conductor to the shield shell in a more ensured fashion.

DETAIL DESCRIPTION OF PREFERRED EMBODIMENTS

Hereinafter, an embodiment of a shielded-conductor cable fixing construction according to the invention will be described based on FIGS. 1 to 4.

Figure 1:
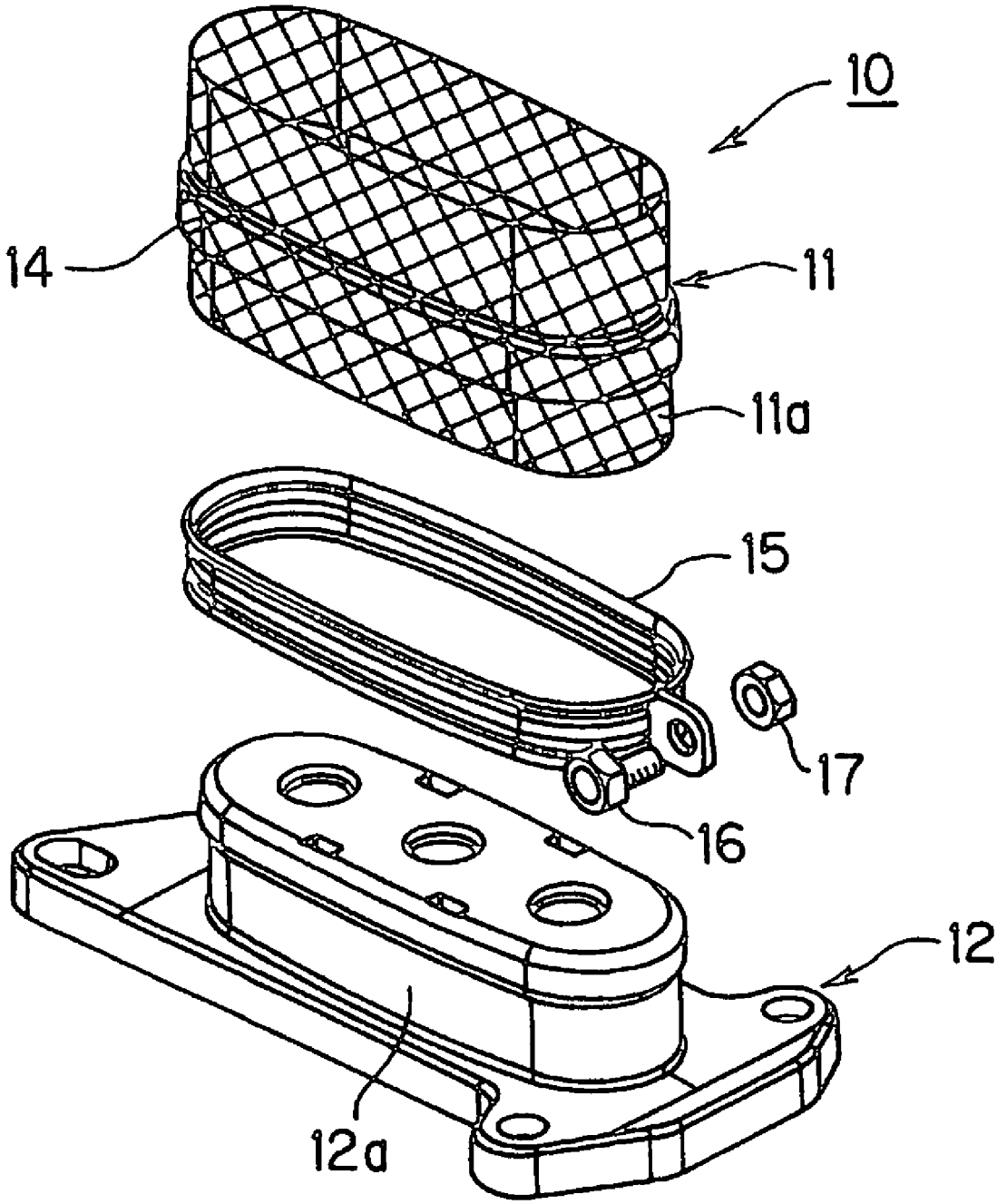
FIG. 1 is an exploded perspective view showing a shielded-conductor cable fixing construction according to an embodiment of the invention.
Figure 2:
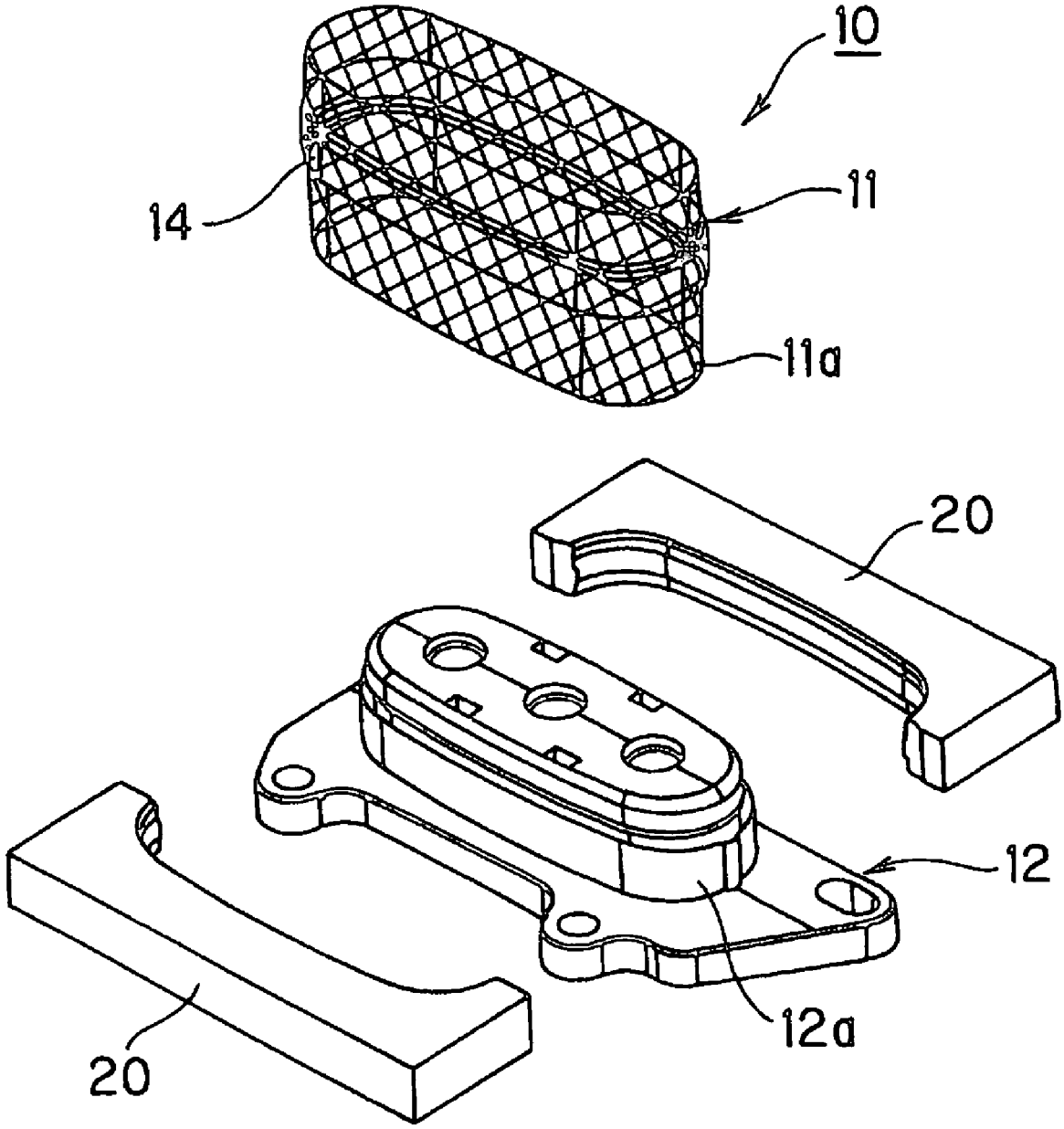
FIG. 2 is an exploded perspective view showing a state of the shielded-conductor cable fixing construction shown in FIG. 1 before clamping by dice is carried out thereon.
Figure 3:
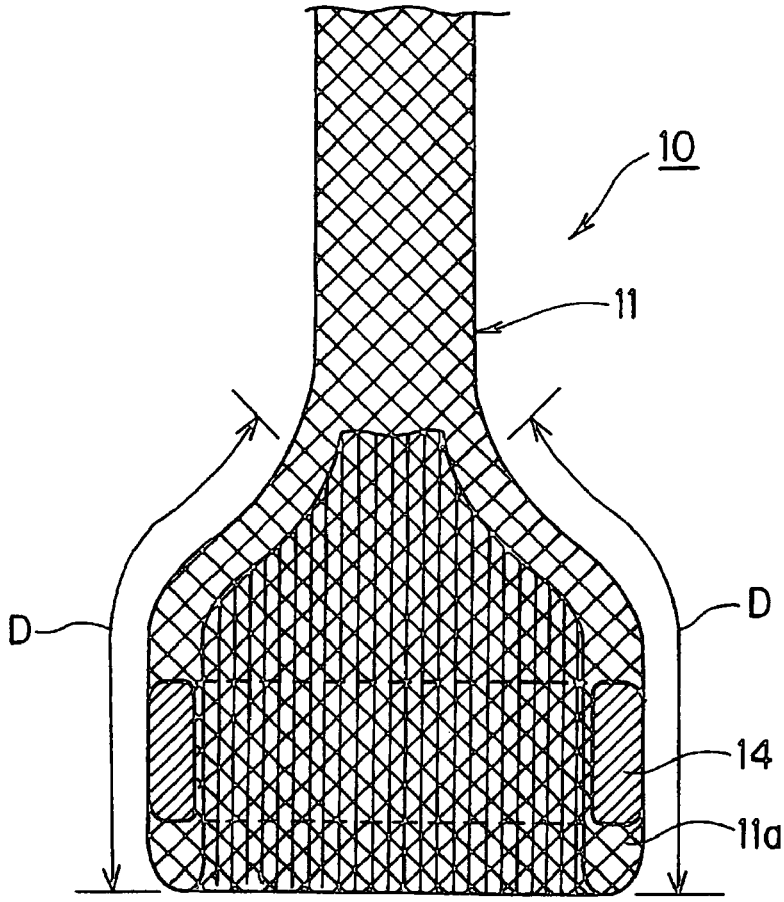
FIG. 3 is a schematic sectional view of a main portion of the shielded-conductor cable fixing construction shown in FIG. 1 which shows an open end portion of a braided conductor thereof.
Figure 4:
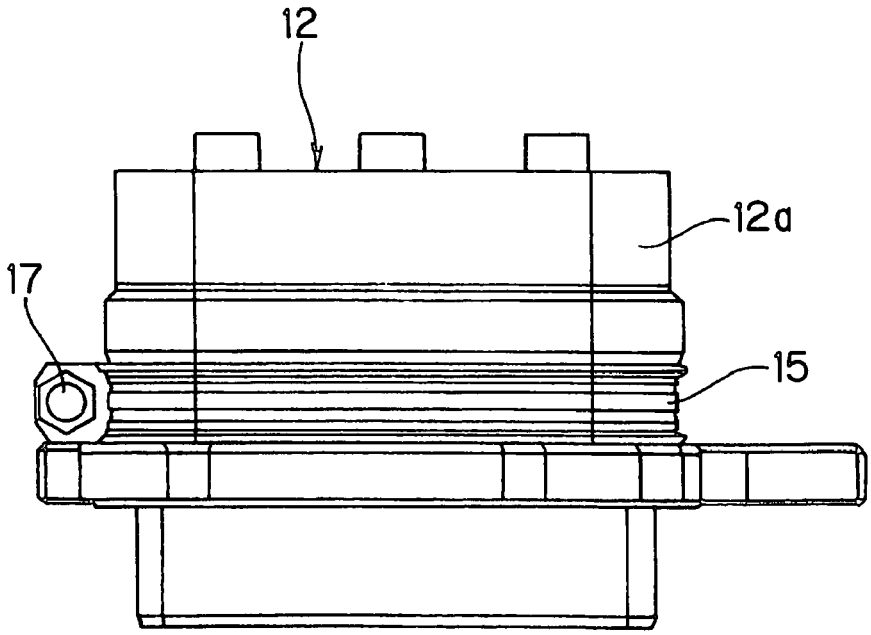
FIG. 4 is a side view of a shield shell of the shielded-conductor cable fixing construction shown in FIG. 1.
Figure 5:
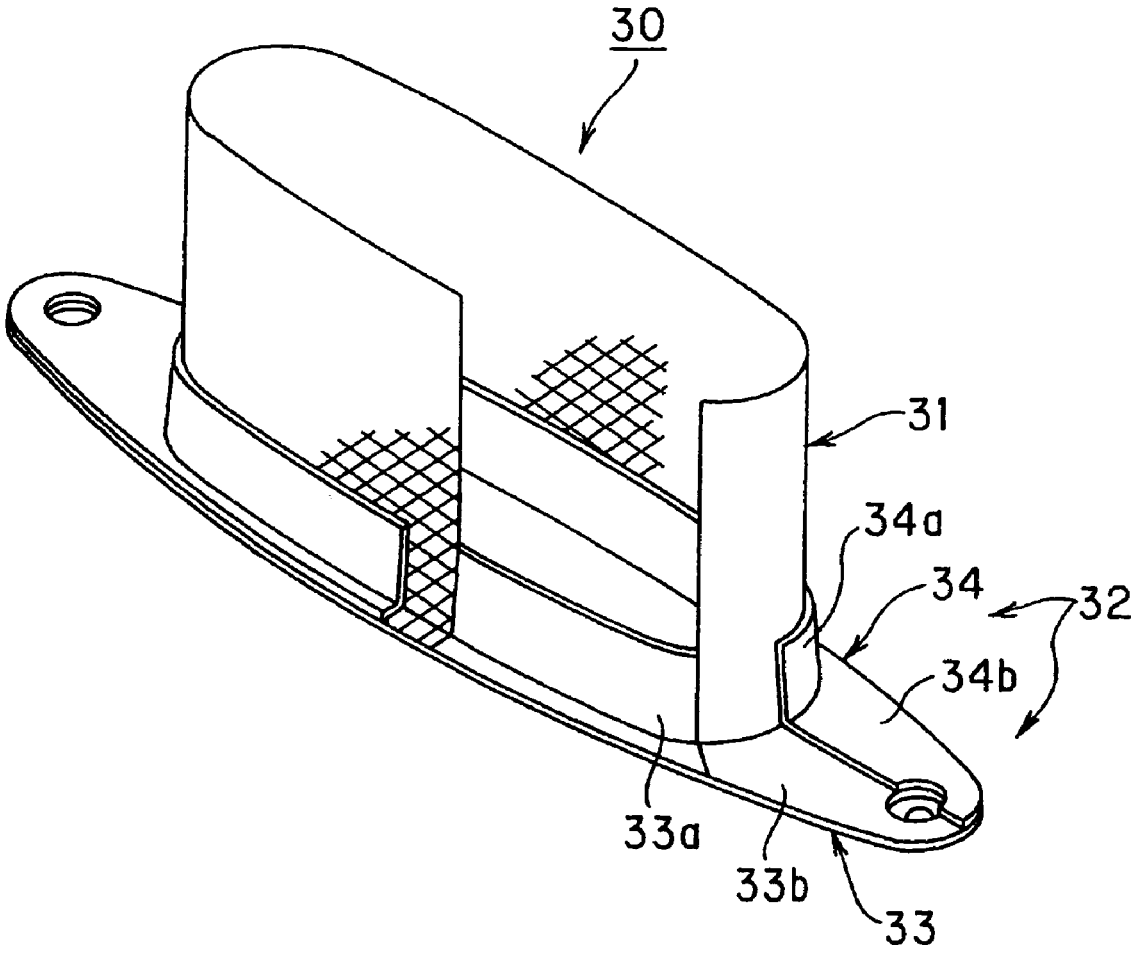
FIG. 5 Prior Art
FIG. 5 is a perspective view showing a state in which a shielding member and a shield shell of an equipment shield connector disclosed in Patent Document 1 are fixed to each other.
Figure 6:
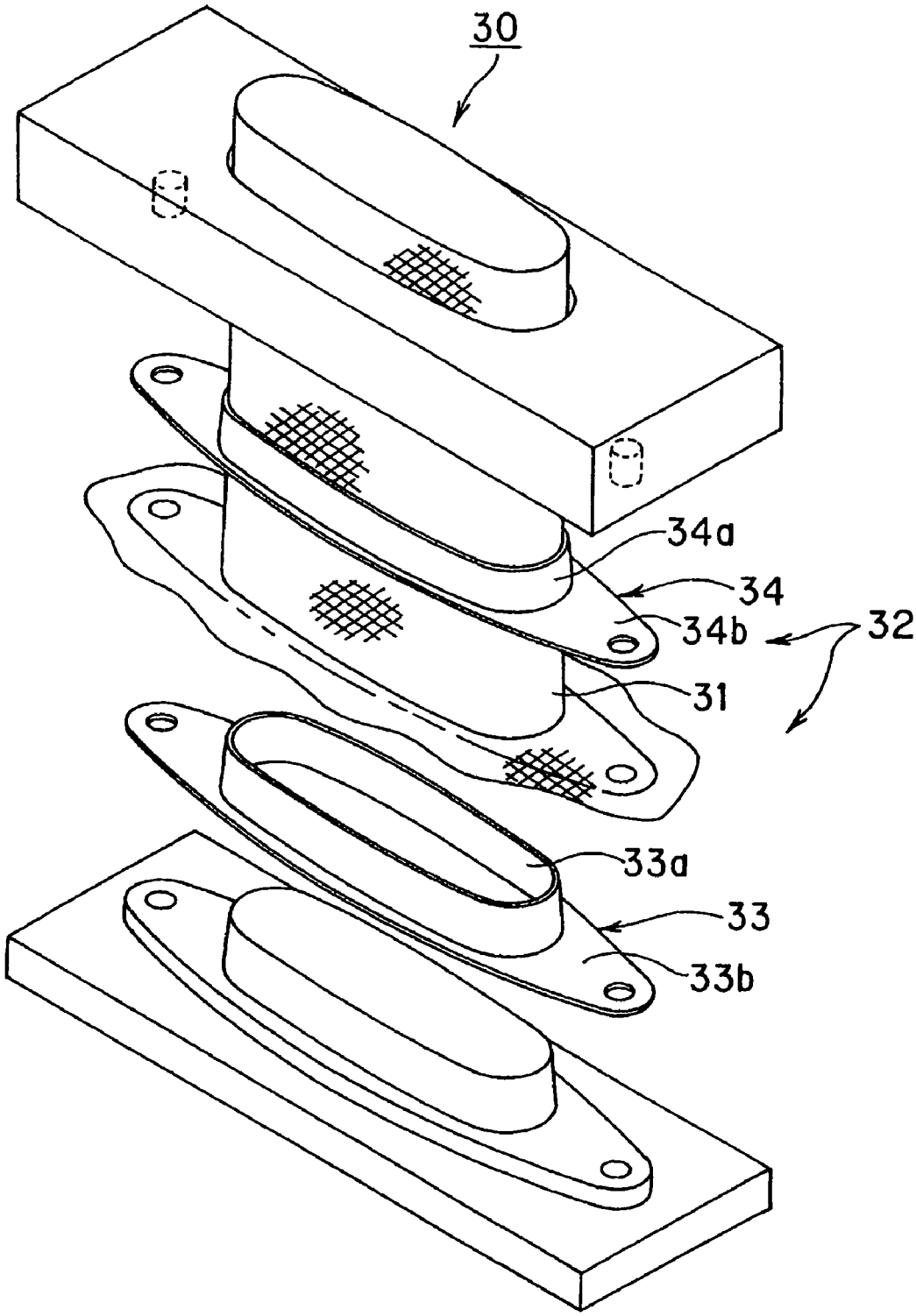
FIG. 6 Prior Art
FIG. 6 is an exploded perspective view of the equipment shield connector shown in FIG. 5.
Figure 7:
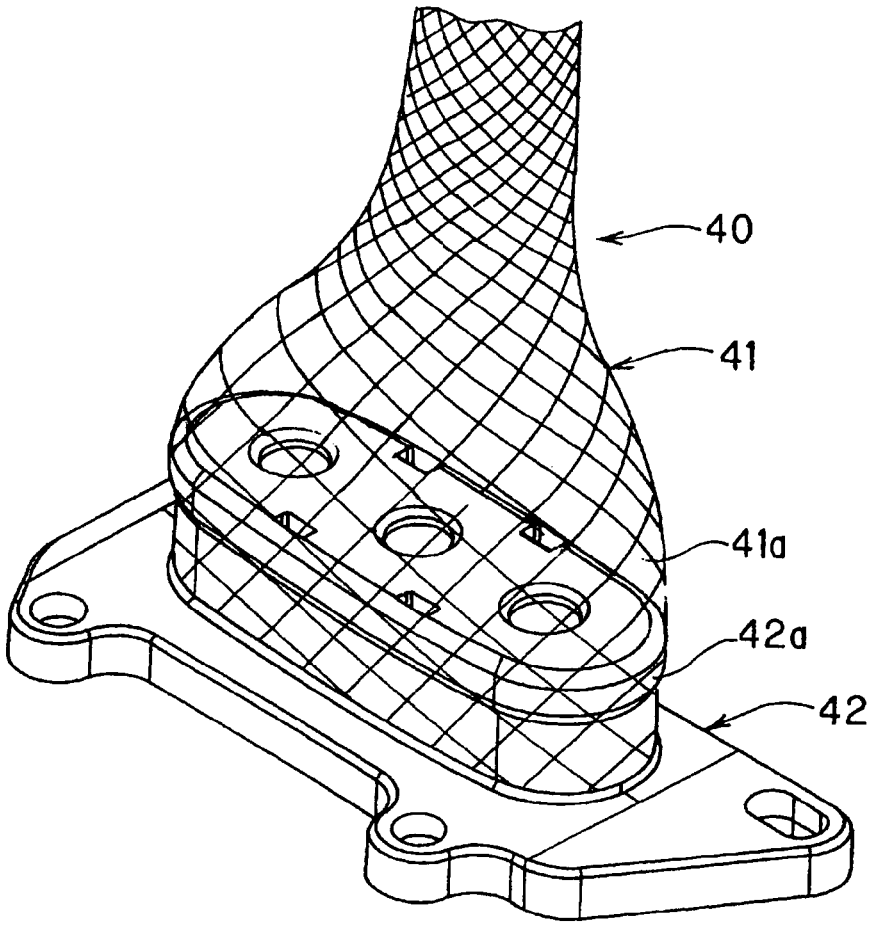
FIG. 7 Prior Art
FIG. 7 is a perspective view showing a main part of a related shielded-conductor cable fixing construction.
Figure 8:
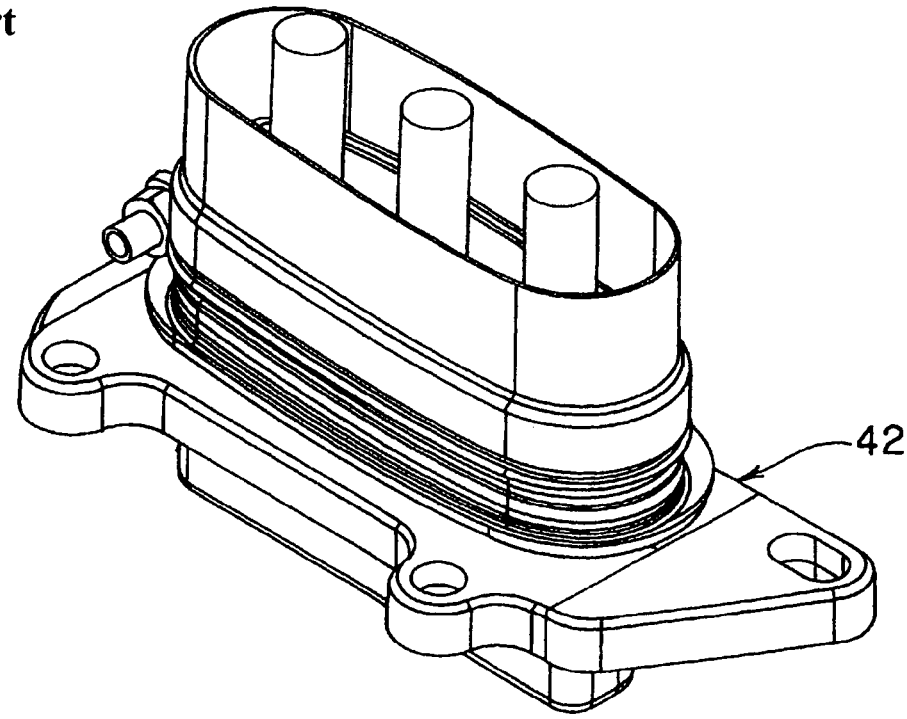
FIG. 8 Prior Art
FIG. 8 is a perspective view showing a shield shell of the shielded-conductor cable fixing construction shown in FIG. 7.

FIG. 1 is an exploded perspective view showing a shielded-conductor cable fixing construction according to an embodiment of the invention, FIG. 2 is an exploded perspective view showing a state of the shielded-conductor cable fixing construction shown in FIG. 1 before clamping by dice is carried out thereon, FIG. 3 is a schematic sectional view of a main portion of the shielded-conductor cable fixing construction shown in FIG. 1 which shows an open end portion of a braided conductor thereof, and FIG. 4 is a side view of a shield shell of the shielded-conductor cable fixing construction shown in FIG. 1.

Referring to FIGS. 1 to 4, in a shielded-conductor cable fixing construction, a shielded-conductor cable 10 is constructed such that a plurality of insulated electric wires (not shown) are covered with a tubular braided conductor 11, and an open end portion 11*a* of the braided conductor 11 is fitted on a ring 12*a* of a shield shell 12 in such a manner as to expand an inside diameter of the open end portion 11*a*, so that the braided conductor 11 is connected to the shield shell 12. The shield shell 12 is coupled and connected to a shield case (not shown), whereby the shielded-conductor cable 10 is grounded to the shield case via the braided conductor 11 and the shield shell 12.

Namely, as shown in FIG. 1, the braided conductor 11 is fitted on the ring 12*a* of the shield shell 12 in such a state that a portion (a range indicated by a reference character D in FIG. 3) of the open end portion where the inside diameter of the braided conductor is expanded is folded over on itself on an inside diameter side of the open end portion so as to be doubled inwards. An annular member 14 is interposed in the braided conductor 11 at the portion (refer to the range indicated by the reference numeral D in FIG. 3) where the braided conductor 11 is folded over on itself on the inside diameter side of the open end portion 11*a* of the braided conductor 11. The folding over of the braided conductor 11 on itself at a predetermined position on the open end portion on the inside diameter side thereof is ensured by the interposition of the annular member 14.

In addition, an annularly formed band 15 is fitted on an outside diameter portion of the open end portion 11*a* of the braided conductor 11 in such a state that an inside diameter portion of the open end portion 11*a* is fitted on the ring 12*a* of the shield shell 12, so that the braided conductor 11 is fastened between the ring 12*a* of the shield shell 12 and the annularly formed band 15 when the band 15 is caused to contract diametrically by tightening a bolt 16 into a nut 17, whereby the braided conductor 11 is fixed to the ring 12*a* of the shield shell 12 strongly and rigidly.

The function of the embodiment will be described.

In the fixing construction of the shielded-conductor cable 10, the shielded conductor portion 11 is fitted on the ring 12*a* of the shield shell 12 in such a manner as to expand the inside diameter thereof in such a state that the portion (refer to the range D in FIG. 3) of the open end portion 11*a* where the inside diameter thereof is expanded, is folded over on itself so as to be doubled inwards and the annular member 14 is held in the doubled portion of the open end portion.

Next, as shown in FIG. 2, the doubled portion of the open end portion 11*a* of the braided conductor 11 is clamped by a pair of dice 20 which are made in such a manner as to match the shape of the ring 12*a* of the shield shell 12 between the ring 12*a* and the dice 20. Then, as shown in FIG. 1, the band 15 is fitted on the outside diameter portion of the open end portion 11*a* of the braided conductor 11, which is so clamped, so that the open end portion 11*a* of the braided conductor 11 is fastened between the band 15 and the ring 12*a* of the shield shell 12 by effect of the diametrical contraction of the band 15 in association with the tightening of the bolt 16 into the nut 17.

Thereafter, the shield shell 12 is coupled and connected to the shield case(not shown), whereby the shielded-conductor cable 10 is grounded to the shield case via the braided conductor 11 and the shield shell 12.

Thus, according to the embodiment of the invention, the braided conductor 11 of the shielded-conductor cable 10 is fitted on the ring 12*a* of the shield shell 12 in such a manner as to expand the inside diameter thereof in such a state that the portion (refer to the range D in FIG. 3) of the open end portion 11*a* where the inside diameter of the braided conductor 11 is expanded is folded over on itself on the inside diameter side of the open end portion 11*a* so as to be doubled inwards and the annular member 14 is held in the doubled portion. Then, the open end portion 11*a* of the shielded conductor 11 is clamped by the dice 20 between the ring 12*a* of the shield shell 12 and the dice 20, and thereafter, the band 15 is fitted on the outside diameter portion of the open end portion 11*a*, so that the open end portion 11*a* of the shielded conductor 11 is fastened between the ring 12*a* of the shield shell 12 and the band 15 by effect of the diametrical contraction of the band 15 in association with the tightening of the bolt 16 into the nut 17.

Consequently, it is possible to enable the securing of high shielding properties and the fixing of the braided conductor to the shield shell in a strong and rigid fashion at low costs without making dense the interstices of the braided conductor 11. Namely, the interstices of the braided conductor 11 at the open end portion 11*a* thereof can be made substantially dense without calling for an increase in costs, whereby it is possible to ensure the high shielding properties at low costs.

In addition, the friction between the open end portion 11*a* of the braided conductor 11 and the ring 12*a* of the shield shell 12 can be increased, whereby the fixing force of the braided conductor 11 to the shield shell 12 can be enhanced, thereby making it possible to prevent the dislocation of the braided conductor 11 from the shield shell 12.

Furthermore, the state can be avoided in which the sharply pointed distal end portion of the braided conductor 11 protrudes outwards from the open end portion 11*a* of the braided conductor 11 in such a state that the braided conductor 11 is fixed to the shield shell 12, whereby a post-treatment such as of cutting the sharply pointed distal end portion of the braided conductor 11 can be eliminated, leading to a further reduction in costs.

Note that in the embodiment, the portion of the open end portion 11*a* of the braided conductor 11 where the inside diameter thereof is expanded may only have to be folded over on itself on the inside diameter side of the open end portion 11*a* so as to be doubled inwards, and hence, the annular member 14 does not always have to be interposed in the doubled portions of the braided conductor 11.

The shielded-conductor cable fixing construction that is obtained according to the invention can be preferably applied to a fixing construction for shielded-conductor cables which are connected to an inverter system or the like on an electric vehicle.

What is claimed is:

1. A shielded-conductor cable fixing construction comprising:

a shield shell having a protruding portion; and a tubular braided conductor that covers an insulated electric wire, wherein an end of the tubular braided conductor running circumferentially around the tubular braided conductor is tucked into an internal portion of the tubular braided conductor to form a doubled over portion and the doubled over portion is fitted around the protruding portion.

2. A shielded-conductor cable fixing construction according to claim 1, further comprising an annular member positioned within the tubular braided conductor to ensure the doubled over portion ends at a predetermined position.

3. A shielded-conductor cable fixing construction according to claim 1, wherein the shield shell has a ring portion on said protruding portion, and the doubled over portion is clamped by a plurality of clamping members, wherein each clamping member has a surface substantially conforming to a shape of an external surface of the ring portion.

4. A shielded-conductor cable fixing construction according to claim 3, wherein the doubled over portion is fastened by a band on an outside diameter portion of the doubled over end portion.

* * * * *